US008092199B2

(12) United States Patent
Mizuno et al.

(10) Patent No.: US 8,092,199 B2
(45) Date of Patent: Jan. 10, 2012

(54) SCROLL COMPRESSOR INCLUDING A PLURALITY OF SHOULDER SECTIONS

(75) Inventors: Hisao Mizuno, Aichi (JP); Takahide Ito, Aichi (JP); Akihiro Noguchi, Aichi (JP); Toshiyuki Shikanai, Aichi (JP); Takashi Goto, Aichi (JP); Yuichi Muroi, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 265 days.

(21) Appl. No.: 12/442,570

(22) PCT Filed: Sep. 9, 2008

(86) PCT No.: PCT/JP2008/066219

§ 371 (c)(1), (2), (4) Date: Mar. 24, 2009

(87) PCT Pub. No.: WO2009/034964

PCT Pub. Date: Mar. 19, 2009

(65) Prior Publication Data

US 2009/0317275 A1 Dec. 24, 2009

(30) Foreign Application Priority Data

Sep. 13, 2007 (JP) ..... 2007-237798

(51) Int. Cl.
*F03C 2/00* (2006.01)
*F03C 4/00* (2006.01)
*F04C 2/00* (2006.01)

(52) U.S. Cl. ..... 418/55.2; 418/55.1; 418/55.5; 418/57; 418/150

(58) Field of Classification Search ..... 418/55.1–55.6, 418/57, 150

See application file for complete search history.

(56) References Cited

U.S. PATENT DOCUMENTS

| | | | | |
|---|---|---|---|---|
| 4,477,238 | A * | 10/1984 | Terauchi | 418/55.2 |
| 6,659,745 | B2 * | 12/2003 | Fujita et al. | 418/55.2 |
| 6,746,224 | B2 * | 6/2004 | Itoh et al. | 418/55.2 |
| 7,344,365 | B2 * | 3/2008 | Takeuchi et al. | 418/55.2 |

FOREIGN PATENT DOCUMENTS

| | | | |
|---|---|---|---|
| JP | 58-30494 | A | 2/1983 |
| JP | 2001-55989 | A | 2/2001 |
| JP | 2002-005046 | A | 1/2002 |
| JP | 2002005052 | A * | 1/2002 |
| JP | 2002-70769 | A | 3/2002 |
| JP | 2002-364560 | A | 12/2002 |
| JP | 2006-342776 | A | 12/2006 |

* cited by examiner

OTHER PUBLICATIONS

International Search Report of PCT/JP2008/066219, date of mailing date Dec. 9, 2008.

*Primary Examiner* — Theresa Trieu
(74) *Attorney, Agent, or Firm* — Westerman, Hattori, Daniels & Adrian, LLP

(57) ABSTRACT

Provided is a scroll compressor that is capable of three-dimensional compression, ensuring a required wrap strength while increasing a shoulder section height of a spiral wrap, and facilitating wrap processing. The scroll compressor includes shoulder sections at an end surface and a bottom surface of spiral wraps of a paired fixed scroll member and revolving scroll member and configured to be capable of three-dimensional compression in a circumferential direction and a height direction of the spiral wraps by setting a spiral wrap height of the spiral wraps further toward the outside of the shoulder sections greater than the spiral wrap height of the inward side, and wherein the shoulder sections provided on the end surface and the bottom surface at the spiral wrap are constructed of a plurality of shoulder sections, and the heights of the shoulder sections are set to heights in which base stresses at the shoulder sections are substantially equal.

5 Claims, 4 Drawing Sheets

SCROLL COMPRESSOR INCLUDING A PLURALITY OF SHOULDER SECTIONS

TECHNICAL FIELD

The present invention relates to a scroll compressor having a configuration that enables three-dimensional compression in the circumferential direction and the height direction of a spiral wrap, the scroll compressor including shoulder sections at an end surface and a bottom surface of the spiral wrap, and the wrap height at the spiral wrap on the side further outward than the shoulder sections being set greater than the wrap height on the inward side.

BACKGROUND ART

As a scroll compressor capable of increasing the compression volume without increasing the outer diameter of scroll members, a scroll compressor has been proposed including shoulder sections at an end surface and a bottom surface of each spiral wrap of a paired fixed scroll member and revolving scroll member, wherein three-dimensional compression is possible in a circumferential direction and a height direction of the spiral wrap by setting a spiral wrap height of the spiral wrap further outward than the shoulder sections greater than the spiral wrap height on the inward side. Since such a compressor is capable of performing compression not only in the circumferential direction of the spiral wraps but also in the wrap height direction, displacement is increased and the compression volume is increased compared with conventional scroll compressors (two-dimensional compression). Therefore, when compared with a compressor having the same volume, advantages such as size reduction and weight reduction are achieved.

In the above-described scroll compressor, stress due to a pressure difference ΔP acting upon both sides of the spiral wraps is applied to the bases of the shoulder sections provided on which the spiral wraps. Patent Document 1 describes a compressor provided with ribs, which are constructed by providing minute corners R at the bases of the shoulder sections, in order to reduce the stress concentration at the bases. Patent Document 2 describes a compressor that is provided with step-like surfaces with a minute height at a notch in a tip seal at the shoulder section to reduce gas leakage from the tip gap at the notch at the tip seal.

Patent Document 1:

Japanese Unexamined Patent Application, Publication No. 2002-5046 (paragraphs [0029] to [0030] and FIG. 4)

Patent Document 2:

Japanese Unexamined Patent Application, Publication No. 2006-342776 (paragraphs [0021] to [0024] and FIG. 1)

DISCLOSURE OF INVENTION

With the scroll compressor capable of three-dimensional compression and having the above-described configuration, the greater the height of the shoulder sections provided at the spiral wraps, the greater the displacement, and thus, those advantages can be achieved. However, when the height of the shoulder section is increased, stress due to the pressure difference ΔP acting upon the base increases, and thus, the strength of the spiral wraps becomes a problem. In particular, under operating conditions where the suction pressure is high, the stress due to the pressure difference ΔP at the outward side in the spiral direction where the spiral wrap height is great becomes large. Since the stress is concentrated at the base of the shoulder section, the ribs described in Patent Document 1 may not provide sufficient wrap strength.

Since the step-like surfaces described in Patent Document 2 are provided to fill the tip gap, the height is minute, i.e., several tens of μm, and therefore a corresponding increase in strength sufficient for counteracting the stress applied to the base of the shoulder section cannot be achieved.

According to such circumstances, there is a need for a countermeasure in which the shoulder section height can be increased, displacement can be increased, and, at the same time, the required wrap strength can be sufficiently ensured in order to fully achieve the advantages of a scroll compressor capable of three-dimensional compression.

The present invention has been conceived in light of such problems, and it is an object thereof to provide a scroll compressor that is capable of three-dimensional compression, sufficiently ensuring a required wrap strength while sufficiently increasing a shoulder section height of a spiral wrap, and facilitating wrap processing.

To solve the above-described problems, the scroll compressor according to the present invention provides the following solutions.

Specifically, the scroll compressor according to the present invention includes shoulder sections at an end surface and a bottom surface of spiral wraps of a paired fixed scroll member and revolving scroll member, which are constructed by vertically mounting the spiral wraps on end plates, and configured to be possible of three-dimensional compression in a circumferential direction and a height direction of the spiral wraps by setting a spiral wrap height further toward the outside of the spiral wraps than the shoulder sections greater than the spiral wrap height at the inward side, wherein the shoulder sections provided on the end surface and the bottom surface of the spiral wrap are constructed of a plurality of shoulder sections, and the heights of the shoulder sections are set to heights such that base stresses at the respective shoulder sections are substantially equal.

According to the present invention, the shoulder sections provided at the end surface and the bottom surface of a spiral wrap are constructed of a plurality of shoulder section, and the height of the shoulder sections are set to heights such that the base stress at the shoulder sections are substantially equal; therefore, at the outward side in the spiral direction where the wrap height of the spiral wraps is great, the stress acting upon the bases of the shoulder sections due to the pressure difference ΔP between both surfaces of the spiral wrap can be dispersed substantially equally, and the stress acting upon the bases of each shoulder section can be reduced by half. In this way, the concentration of the stress due to the pressure difference ΔP can be prevented while sufficiently increasing the shoulder section height, and a required wrap strength can be ensured. Therefore, the advantages of the scroll compressor capable of three-dimensional compression, namely, that the displacement can be increased and the compression volume can be increased without increasing the outer diameter, can be sufficiently achieved. Since the shoulder section is merely constructed of a plurality of shoulders, the processing thereof is not particularly complicated, and the plurality of shoulder sections can easily be processed as an extension of a known scroll member having shoulder sections on the end surface and the bottom surface of the spiral wrap.

The scroll compressor according to the present invention is the scroll compressor according to the present invention described above, wherein a shoulder-to-shoulder distance H satisfies $H \geqq 2L1$ when $\sigma max/\sigma min \leqq 1.5$, where L1 represents the height of a high shoulder section of the plurality of shoulder sections on the inner side in the spiral direction, H represents the shoulder-to-shoulder distance between the high shoulder section and a low shoulder section on the outer side in the spiral direction, and σ represents the stress at the high shoulder section and the low shoulder section.

According to this configuration, by setting the shoulder-to-shoulder distance H to H≧2L1 when the ratio of the minimum stress σmin to the σmax is set to σmax/σmin≦1.5, where L1 represents the height of a high shoulder section, H represents the shoulder-to-shoulder distance, and σ represents the stress at the high shoulder section and the low shoulder section, the base stress σ acting upon each shoulder section of the plurality of shoulder sections can be set substantially equally when the heights of the high shoulder section and the low shoulder section are set arbitrarily. In other words, when σ∞ represents the stress when the shoulder-to-shoulder distance H is sufficiently great, σ∞/σ represents the stress reduction effect (σ∞/σ is the maximum effect). Here, the stress σ when the shoulder-to-shoulder distance H is great peaks (σ∞/σ≈1) at approximately H/L1=5, and the stress reduction effect suddenly reduces at H/L1<2 (see FIG. 6). Therefore, when H≧2L1, the base stresses acting upon each shoulder section can be set substantially equal, and, for example, even if the height L1 of the high shoulder section is reduced as much as possible, the stress due to the pressure difference ΔP applied to both surfaces of the spiral wrap can be dispersed to the plurality of shoulder sections substantially equally, and the stress acting upon the base of each shoulder section can be reduced. In this way, concentration of stress due to the pressure difference ΔP can be prevented while sufficiently increasing the shoulder section height, and the required wrap strength can be ensured.

The scroll compressor according to the present invention is the scroll compressor according to the present invention described above, wherein a shoulder-to-shoulder distance H satisfies H≧α(L+Lr) when α≧0.5 when the heights of the plurality of shoulder sections are set to be substantially equal, where L represents a wrap height of a spiral wrap on a side further inward than the shoulder section, Lr represents the height of the shoulder constructed of the plurality of shoulder sections, and H represents the shoulder-to-shoulder distance between a high shoulder section on the inner side in the spiral direction of the plurality of shoulder sections and a low shoulder section on the outer side thereof.

According to this configuration, by setting the shoulder-to-shoulder distance H to H≧α(L+Lr) when α≧0.5, where L represents a wrap height of a spiral wrap on a side further inward than the shoulder section, Lr represents the height of the shoulder constructed of the plurality of shoulder sections, and H represents the shoulder-to-shoulder distance, the base stresses acting upon each shoulder section of the plurality of shoulder sections can be set substantially equally by setting the heights of the plurality of shoulder sections substantially equal. Here, based on the relationship between L1/L2 and H/L+Lr, α is at least 0.5 when the height L1 of the high shoulder section and the height L2 of the low shoulder section are set equal (L1=L2) (see FIG. 7). Therefore, by setting H≧α(L+Lr) when α≧0.5, even when the heights of the plurality of shoulder sections are set to be substantially equal, the base stresses acting upon each shoulder section can be set to be substantially equal, the stress due to the pressure difference ΔP applied to both surfaces of the spiral wrap can be dispersed to the plurality of shoulder sections substantially equally, and the stress acting upon the base of each shoulder section can be reduced. In this way, concentration of stress due to the pressure difference ΔP can be prevented while sufficiently increasing the shoulder section height, and the required wrap strength can be ensured.

The scroll compressor according to the present invention is the scroll compressor according to the present invention described above, wherein ribs are provided at bases of the plurality of shoulder sections, which are provided at the end surfaces of the spiral wraps.

According to this configuration, since the ribs are provided at the bases of the plurality of shoulder sections provided at the end surface of the spiral wraps, stress concentration at the bases of the shoulder sections can be reduced. Therefore, the strength of the spiral wrap having a plurality of shoulder sections can be increased even more.

The scroll compressor according to the present invention is the scroll compressor according to the present invention described above, wherein chamfers or braces for preventing interference with the ribs are provided on the bottom surface side of the counterpart scroll member engaging with the fixed scroll member or the revolving scroll member on which the ribs are provided.

According to this configuration, since chamfers or braces for preventing interference with the ribs are provided on the bottom surface side of the counterpart scroll member on which the ribs are provided, interference with the ribs for reducing stress concentration can be prevented, and the revolving scroll member can smoothly orbit around the fixed scroll member. In this way, ribs for reducing stress concentration can be provided at the base of each shoulder section, and the strength of the spiral wrap having a plurality of shoulder sections can be increased even more.

According to the present invention, the concentration of the stress due to the pressure difference ΔP can be prevented while sufficiently increasing the shoulder section height, and a required wrap strength can be ensured; therefore, the advantages of the scroll compressor capable of three-dimensional compression, namely, that the displacement can be increased and the compression volume can be increased without increasing the outer diameter can be sufficiently achieved. Since the shoulder section is merely constructed of a plurality of shoulders, the processing thereof is not particularly complicated, and shoulder sections can easily be processed as an extension of a known scroll member having shoulder sections on the end surface and the bottom surface of the spiral wrap.

EXPLANATION OF REFERENCE SIGNS

1: sealed scroll compressor
15: fixed scroll member

15A: end plate
15B: spiral wrap
15E: bottom surface
15P: chamfer
16: revolving scroll member
16A: end plate
16B: spiral wrap
16D, 16H, 16I: end surfaces
16E, 16J, 16K: bottom surfaces
16F, 16G: shoulder sections (shoulder sections constituting low shoulder sections)
16L, 16M: high shoulder sections
16N: rib

BEST MODE FOR CARRYING OUT THE INVENTION

Embodiments of the present invention will be described below with reference to the drawings.

First Embodiment

A first embodiment of the present invention will be described with reference to FIGS. 1 to 6.

Figure 1:
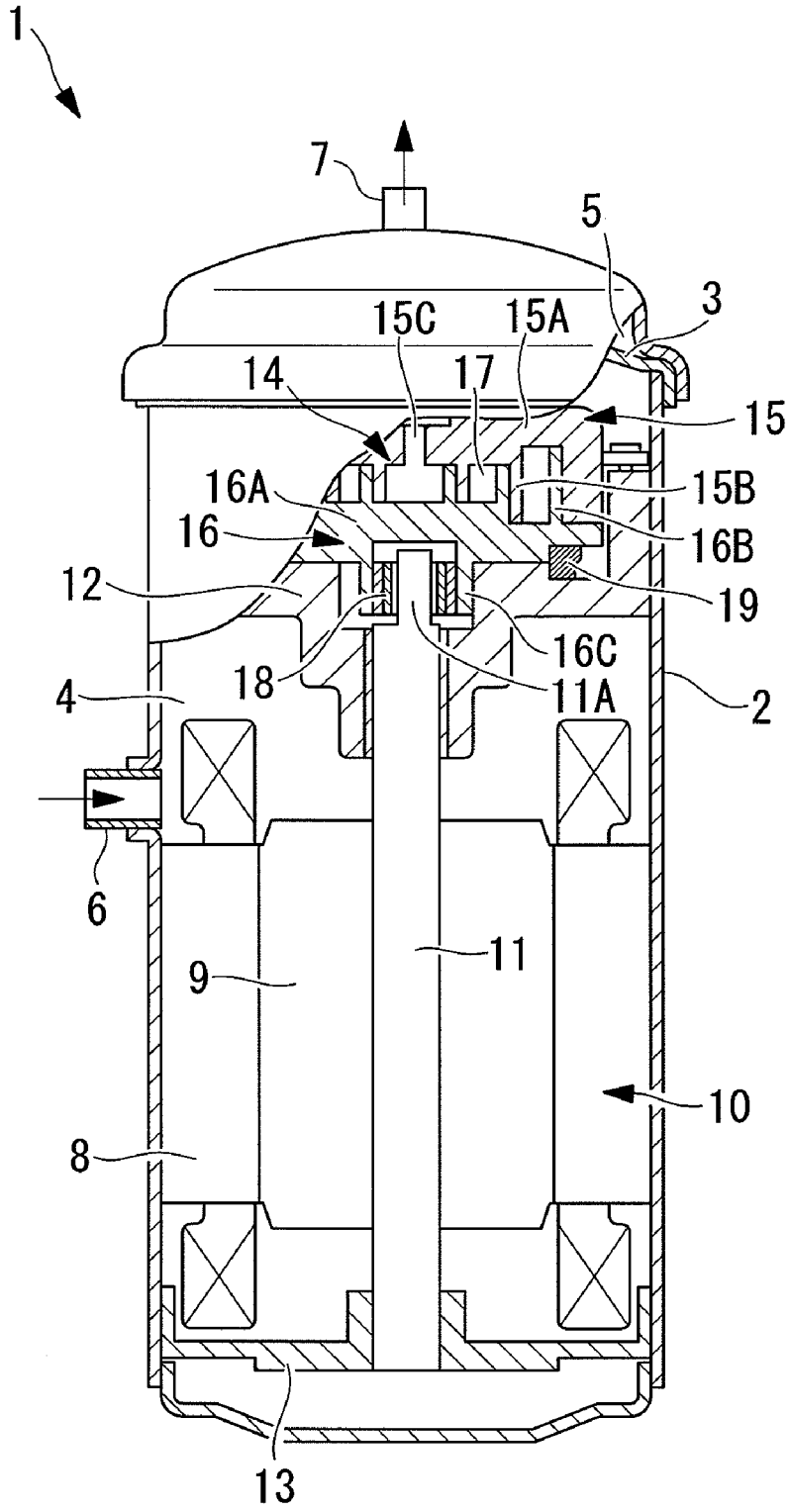
FIG. 1 is a partial longitudinal sectional view of a scroll compressor according to a first embodiment of the present invention.

FIG. 1 is a partial longitudinal sectional view of a sealed scroll compressor according to the first embodiment of the present invention. A sealed scroll compressor 1 includes a sealed housing 2 whose interior is partitioned into a low-pressure chamber (intake chamber) 4 side and a high-pressure chamber (discharge chamber) 5 side by a discharge cover 3. The low-pressure chamber 4 is connected to an intake pipe 6 for taking in low-pressure refrigerant gas from the refrigerant circuit. The high-pressure chamber 5 is connected to a discharge pipe 7 for discharging compressed high-pressure gas to the refrigerant circuit.

An electric motor 10 constructed of a stator 8 and a rotor 9 is securely mounted on the lower section inside the sealed housing 2. A crank shaft 11 is integrated with the rotor 9. The crank shaft 11 is supported, in such a manner that it freely rotates, by an upper bearing 12 and a lower bearing 13, which are securely mounted inside the sealed housing 2, and is rotationally driven by the electric motor 10. A scroll compressor mechanism 14, which is constructed by combining paired fixed scroll member 15 and revolving scroll member 16, is installed to the upper bearing 12. The fixed scroll member 15 is constructed of an end plate 15A having a discharge port 15C and a spiral wrap 15B provided vertically on the end plate 15A. The revolving scroll member 16 is constructed of an end plate 16A having a boss section 16C on the back side and a spiral wrap 16B provided vertically on the end plate 16A.

The fixed scroll member 15 and the revolving scroll member 16 are assembled by disposing the centers thereof apart by a distance equal to the revolving radius and by meshing them with the phases of the spiral wraps 15B and 16B by shifted 180°. In this way, a pair of compression chambers 17 and 17, which are bounded by the end plates 15A and 16A and the spiral wraps 15B and 16B, are formed between the scroll members 15 and 16 in such a manner that they are symmetrical with respect to the scroll center. The fixed scroll member 15 is securely mounted on the upper bearing 12 with bolts, etc. In the revolving scroll member 16, a crank pin 11A provided on one end of the crank shaft 11 is connected to the boss section 16C provided on the back of the end plate 16A with a drive bush 18, and the revolving scroll member 16 is driven in a revolving manner by the rotation of the crank shaft 11.

The back of the end plate 16A of the revolving scroll member 16 is supported by a thrust surface 12A formed on the upper bearing 12. Furthermore, a rotation prevention mechanism 19, which is constructed of a pin ring mechanism, an Oldham ring mechanism, or the like, is interposed between the thrust surface 12A and the back of the end plate 16A. The revolving scroll member 16 is constructed such that it is orbitally driven around the fixed scroll member 15 while its rotation is prevented by the rotation prevention mechanism 19.

The above-described scroll compressor 1 operates to take low-pressure refrigerant gas, which is taken in to the low-pressure chamber 4 inside the sealed housing 2 through the intake pipe 6, in to the pair of compression chambers 17 and 17 of the scroll compressor mechanism 14 and to compress the refrigerant gas to a high-temperature, high-pressure state. The scroll compressor mechanism 14 performs the compression by driving the crank shaft 11 with the motor 10 such that the crank shaft 11 rotates and by moving the orbiting scroll member 16 connected to the crank pin 11A such that the orbiting scroll member 16 orbits around the fixed scroll member 15 while the rotation prevention mechanism 19 prevents rotation. This compression operation causes the compression chambers 17 to move toward the center while reducing their volumes and causes the refrigerant gas compressed to a high-temperature, high-pressure state to be discharged from the discharge port 15C into the high-pressure chamber 5 and then discharged outside through the discharge pipe 7.

In the above-described scroll compressor, the fixed scroll member 15 and the revolving scroll member 16 are constructed with shoulder sections thereof provided at predetermined positions on the end surfaces and bottom surfaces of the spiral wraps 15B and 16B along the spiral direction. The specific configuration of the revolving scroll member 16 will be described below as an example. Although the external shape of the fixed scroll member 15 differs from that of the revolving scroll member 16, the configurations of the end surface and bottom surface of the spiral wrap 15B and the shoulder sections are symmetrical to those of the revolving scroll member 16, and therefore, descriptions thereof are omitted.

Figure 2:
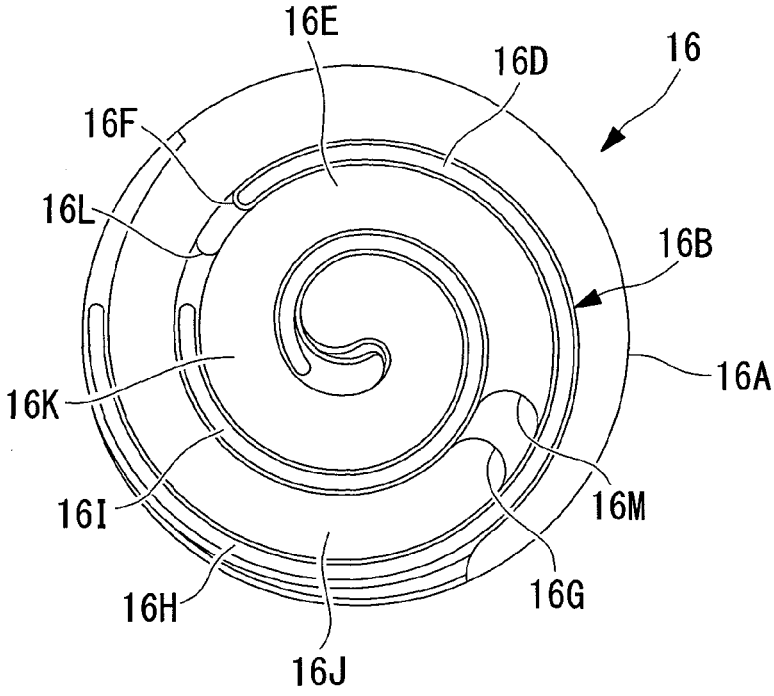
FIG. 2 is a plan view of a revolving scroll member of the scroll compressor shown in FIG. 1.
Figure 3:
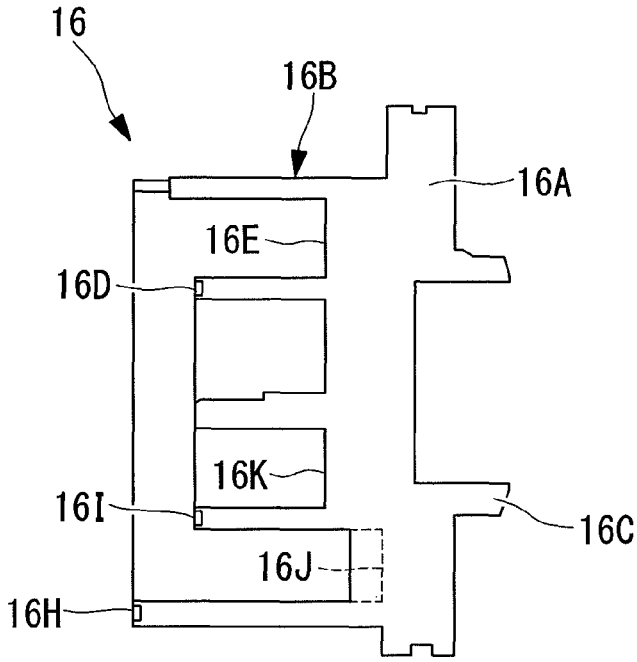
FIG. 3 is a longitudinal sectional view of the revolving scroll member of the scroll compressor shown in FIG. 2.

As shown in FIGS. 2 and 3, in the revolving scroll member 16, shoulder sections 16F and 16G are provided at predetermined positions in the spiral direction of an end surface 16D and a bottom surface 16E of the spiral wrap 16B. At the wrap end surface 16D, at the boundary of these shoulder sections 16F and 16G, the end surface 16H on the outward side in the center axis L direction of the revolving scroll member 16 is high, and the end surface 16I on the inward side is low. At the bottom surface 16E, the bottom surface 16J on the outward side in the center axis L direction is low, and the bottom surface 16K on the inward side is high. In this way, the wrap height of the spiral wrap 16B is higher on the outward side of the shoulder sections than the wrap height on the inner side.

The spiral wrap 15B of the fixed scroll member 15 has the same configuration as the above-described spiral wrap 16B of the revolving scroll member 16. The pair of compression chambers 17 and 17 formed by engaging the fixed scroll member 15 and the revolving scroll member 16, which have the above-described configurations, have heights in the center axis L direction that are greater on the outward sides of the spiral wraps 15B and 16B than on the inward sides. In this way, the scroll compressor mechanism 14 capable of three-dimensional compression, in which compression can be performed in the circumferential direction of the spiral wraps 15B and 16B and the wrap height direction, is constructed.

According to this embodiment, the above-described shoulder sections 16F and 16G are each constructed of a plurality of shoulder sections. In other words, by providing high shoulder sections 16L and 16M at the bases of the shoulder sections 16F and 16G, respectively, which are provided on the end surface 16D and the bottom surface 16E of the spiral wrap 16B, the shoulder sections 16F and 16G are constructed of a plurality of (two) shoulder sections, i.e., the high shoulder sections 16L and 16M, which are provided on the inward side in the spiral direction, and the shoulder sections 16F and 16G constituting the low shoulder sections, which are provided on the outward side in the spiral direction. The height L1 of the high shoulder sections 16L and 16M constituting the plurality of shoulder sections and the height L2 of the shoulder sections 16F and 16G constituting the low shoulder sections are set to so that the base stresses applied to the shoulder sections 16L and 16M and the shoulder sections 16F and 16G are substantially the same.

Figure 4:
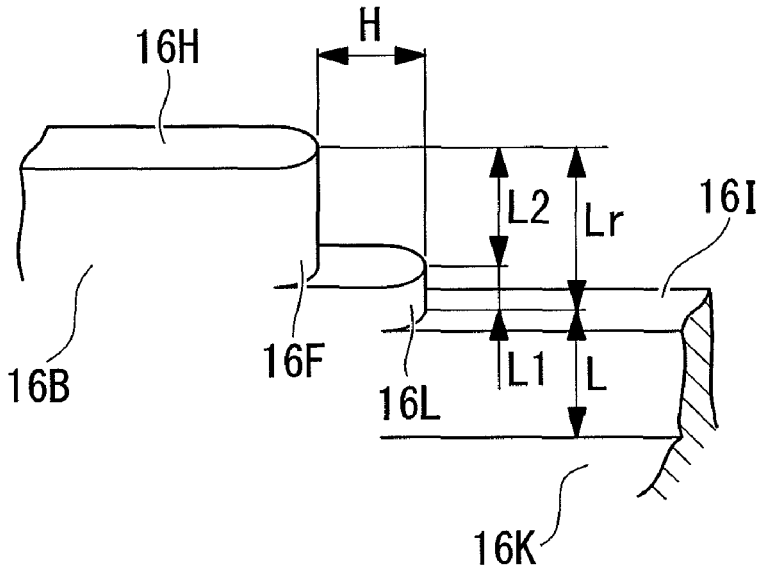
FIG. 4 is a perspective development view of shoulder sections provided on a spiral wrap of the revolving scroll member of the scroll compressor shown in FIG. 2.

To set the base stresses a caused by the pressure difference ΔP, which is applied to both sides of the spiral wraps, acting upon the high shoulder sections 16L and 16M and the shoulder sections 16F and 16G constituting the low shoulder sections to be substantially the same, the heights of the high shoulder sections 16L and 16M and the shoulder sections 16F and 16G constituting the low shoulder sections must be set as described in the following. Specifically, as shown in FIG. 4, the shoulder-to-shoulder distance H may be set to satisfy $H \geqq 2L1$ when $\sigma max/\sigma min \leqq 1.5$, where L1 represents the height of the high shoulder section 16L, L2 represents the height of the shoulder section 16F constituting the low shoulder section, Lr (Lr=L1+L2) represents the height of the shoulder section constructed of a plurality of shoulder sections, H represents the shoulder-to-shoulder distance between the high shoulder section 16L and the shoulder section 16F constituting the low shoulder section, and σ represents the base stresses acting upon the shoulder sections 16F and 16M. In such a case, the height L1 of the high shoulder section 16L and the height L2 of the shoulder section 16F constituting the low shoulder section do not have to be the same; the height L1 of the high shoulder section 16L may be set as low as possible compared with the height L2 of the shoulder section 16F constituting the low shoulder section.

Figure 6:
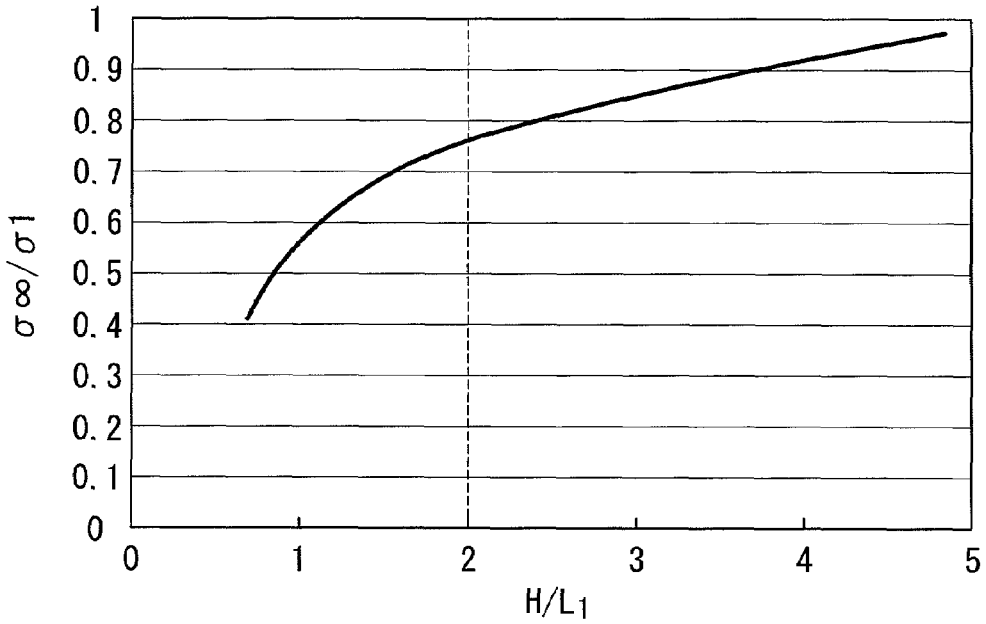
FIG. 6 is graph illustrating the relationship between H/L1 and a stress reduction effect in a scroll compressor according to the first embodiment of the present invention.

Consequently, when the base stresses a acting upon the shoulder sections 16F and 16L are analyzed with the height L1 of the high shoulder section 16L and the shoulder-to-shoulder distance H as parameters, the stress reduction effect ($\sigma\infty/\sigma 1$) suddenly decreased at H/L1<2, as shown in FIG. 6. In FIG. 6, $\sigma\infty/\sigma 1$ indicates the stress reduction effect, and a maximum effect is achieved at $\sigma\infty/\sigma 1=1$, where σ∞ represents the stress when the shoulder-to-shoulder distance H is sufficiently great, σ1 represents the stress (=σ2) at the high shoulder section 16L, and σ2 represents the stress (=σ1) at the shoulder section 16F constituting the low shoulder section. The stress with increased shoulder-to-shoulder distance H peaks at approximately H/L1=5 and does not decrease any further. σ∞ represents a stress value at this time, and a stress reduction effect is achieved by making the stress value σ1 approach the stress value σ∞.

As clearly shown in FIG. 6, at H/L1<2, the stress reduction effect is suddenly reduced. This means that the stress σ1 of the high shoulder section 16L is suddenly increased, and in order to set the base stresses σ acting upon the high shoulder section 16L and the shoulder section 16F constituting the low shoulder section substantially the same, the shoulder-to-shoulder distance H merely has to be set to satisfy H≧2L1. In such a case, the height L1 of the high shoulder section 16L and the height L2 of the low shoulder section 16F do not have to be set to the same height (L1=L2); by setting the height L1 of the high shoulder section 16L as low as possible compared with the height L2 of the low shoulder section 16F, the freedom of design and processing can be ensured.

Figure 5:
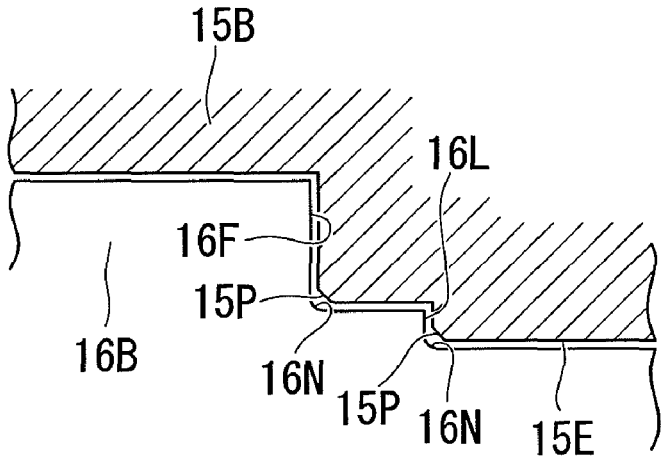
FIG. 5 is a diagram of the engagement state of the shoulder sections provided on the spiral wrap of the revolving scroll member of the scroll compressor shown in FIG. 2.

As shown in FIG. 5, to form the shoulder sections 16F and 16G with a plurality of shoulder sections, ribs (each constructed of, for example, a minute corner R) 16N for releasing the concentrated stress are provided at the bases of the high shoulder section 16L and the shoulder section 16F constituting the low shoulder section. Also, chamfers 15P or braces for preventing interference with the ribs 16N are provided on the bottom surface 15E side of the scroll member engaging with the fixed scroll member 15 or the revolving scroll member 16 on which the ribs 16N are provided.

Similar to shoulder sections provided on the revolving scroll member 16 side, the shoulder section provided on the fixed scroll member 15 side is also constructed of a plurality of shoulder sections.

According to the configuration described above, the scroll compressor according to this embodiment provides the following advantages. In the descriptions below, the parts (not shown in the drawings) corresponding to the fixed scroll member 15 side are provided in parentheses for convenience.

In this embodiment, the shoulder sections 16F and 16G (15F and 15G) provided on the end surface 16D (15D) and the bottom surface 16E (15E) of the fixed scroll member 15 and the revolving scroll member 16 are constructed of the plurality of high shoulder sections 16L and 16M (15L and 15M) and the shoulder sections 16F and 16G (15F and 15G) constituting the low shoulder sections. The heights of the high shoulder sections 16L and 16M (15L and 15M) and the low shoulder sections 16F and 16G (15F and 15G) are set such that the base stresses at the shoulder sections are substantially the same. In this way, at the outward side in the spiral direction where the wrap heights of the spiral wraps 15B and 16B are great, the stresses acting upon the shoulder sections 16F and 16G (15F and 15G) due to the pressure difference ΔP between both surfaces of the spiral wrap can be dispersed substantially equally to the high shoulder sections 16L and 16M (15L and 15M) and the low shoulder sections 16F and 16G (15F and 15G) and can be reduced to substantially half of the stress acting upon the bases of the shoulder sections.

Therefore, the heights of the shoulder sections 16F and 16G (15F and 15G) provided along the spiral direction of the spiral wraps 15B and 16B can be sufficiently increased, and the outward wrap height of the spiral wraps 15B and 16B can be increased. At the same time, concentration of stress due to the pressure difference ΔP generated between both surfaces of the spiral wrap, acting upon the shoulder bases can be prevented, and the necessary wrap strength can be ensured. Consequently, it is possible to fully achieve the advantages of the scroll compressor, which is capable of three-dimensional compression, namely, displacement can be increased without increasing the outer diameters of the fixed scroll members 15 and 16 (without increasing the number of windings) and the compressor volume can be increased.

Since the shoulder sections 16F and 16G (15F and 15G) provided on the spiral wraps 15B and 16B of the fixed scroll member 15 and the revolving scroll member 16 are simply constructed of a plurality of shoulder sections, the processing is not particularly complicated, and the plurality of shoulder sections can easily be processed as an extension of a known scroll member having single shoulder sections 16F and 16G (15F and 15G) on the end surface 16D (15D) and the bottom surface 16E (15E) of the spiral wraps 15B and 16B.

Furthermore, in order to set the heights of the plurality of high shoulder sections 16L and 16M (15L and 15M) and the shoulder sections 16F and 16G (15F and 15G) constituting the low shoulder sections such that the base stresses at the shoulder sections are substantially the same, the heights of the shoulder sections on the higher side and the lower side can be set as desired so long as the relationship H≧2L1 is satisfied. Therefore, the freedom of design and processing can be increased; for example, the height L1 of the high shoulder sections 16L and 16M (15L and 15M) and the height L2 of the low shoulder sections 16L and 16M (15L and 15M) do not have to be set to equal heights, and the height L1 of the high shoulder sections 16F and 16G (15F and 15G) can be set as low as possible compared with the height L2 of the low shoulder sections 16F and 16G (15F and 15G).

Since the ribs 16N (15N) are provided at the bases of the high shoulder sections 16L and 16M (15L and 15M) and the low shoulder sections 16F and 16G (15F and 15G), concentration of stress at the bases of the shoulder sections can be reduced by the ribs 16N (15N). In this way, the strength of the spiral wraps 15B and 16B having shoulder sections can be increased even more.

Moreover, since the chamfers 15P (16P) or the braces for preventing interference with the ribs 16N (15N) are provided on the bottom surface 15E (16E) side of the scroll member engaging with the scroll member on which the ribs 16N (15N) are provided, the revolving scroll member 16 can smoothly orbit around the fixed scroll member 15 without interfering with the ribs 16N (15N) for reducing stress concentration. Therefore, the ribs 16N (15N) can be formed for reducing stress concentration to the bases of the shoulder sections, and thus the strength of the spiral wraps 15B and 16B having shoulder sections can be increased even more.

Second Embodiment

Next, a second embodiment of the present invention will be described with reference to FIGS. 4 to 7.

This embodiment differs from the above-described first embodiment in that the heights of the plurality of shoulder sections are set to be substantially equal. Since other aspects are the same as those according to the first embodiment, descriptions thereof will be omitted.

In this embodiment, the heights of the high shoulder sections 16L and 16M constituting a plurality of shoulder sections and the heights of the shoulder sections 16F and 16G constituting the low shoulder sections are set to be substantially equal so as to set the base stresses at the shoulder section to be substantially equal.

In this embodiment, as shown in FIG. 4, the height L1 of the high shoulder section 16L and the height L2 of the low shoulder section 16F are set to the same height, i.e., L1=L2. In such a case, the shoulder-to-shoulder distance H may be set to H≧α(L+Lr) so that α≧0.5 is satisfied, where Lr (Lr=L1+L2) represents the height of the shoulder section constructed of a plurality of shoulder sections, H represents the shoulder-to-shoulder distance between the high shoulder section 16L and the shoulder section 16F constituting a low shoulder section, and L represents the height from the bottom surface 16K on the inward side of the spiral wrap 16B to the end surface 16I (the wrap height inward of the shoulder section of the spiral wrap 16B). In other words, the shoulder-to-shoulder distance H may be set to a value at least half of the height from the bottom surface 16K on the inward side of the spiral wrap 16B to the end surface 16H on the outward side of the spiral wrap 16B.

Figure 7:
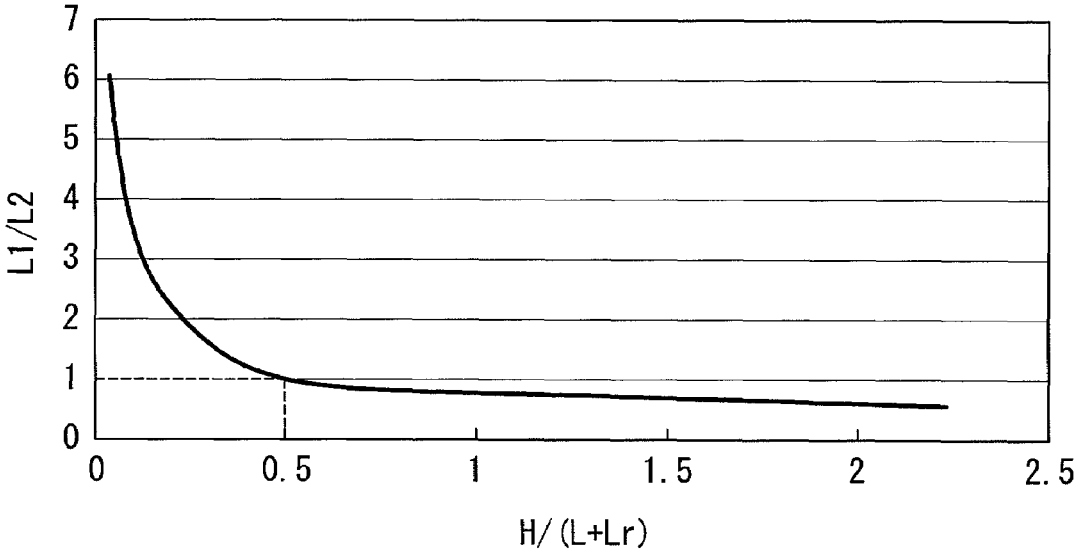
FIG. 7 is graph illustrating the relationship between H/(L+Lr) and L1/L2 in a scroll compressor according to a second embodiment of the present invention.

FIG. 7 illustrates the relationship between L1/L2 and H/L+Lr when the heights of the high shoulder sections 16L and 16M constituting the plurality of shoulder sections and the shoulder sections 16F and 16G constituting the low shoulder sections are set such that the base stresses at the shoulder sections are equal stresses. An apparent from FIG. 7, when the height L1 of the high shoulder section and the height L2 of the low shoulder section are set equal, i.e., when L1/L2=1 (L1=L2), α is at least 0.5.

Therefore, even when the heights of the high shoulder section 16L and the shoulder section 16F constituting the low shoulder section are set to be substantially equal, so long as the shoulder-to-shoulder distance H is H≧α(L+Lr) where α≧0.5, the stresses acting upon each of the high shoulder section 16L constituting the plurality of shoulder sections and the shoulder section 16F constituting the low shoulder section can be set to be substantially equal, the pressure difference ΔP applied to both spiral wrap surfaces can be equally dispersed to the plurality of shoulder sections, i.e., the high shoulder section 16L, and the shoulder section 16F constituting the low shoulder section, and stress applied to each base of the shoulder section can be reduced. In this way, stress concentration due to the pressure difference ΔP can be prevented as well as the heights of the shoulder sections 16F and 16G are set sufficiently great, and thus a necessary wrap strength can be ensured. Moreover, in this embodiment, ribs 16N may be provided at the base of the shoulder sections and chamfers 16P or braces for preventing interference with the ribs 16N may be provided on the bottom surface 16E side of the corresponding scroll member.

The present invention is not limited to the above-described embodiments, and various modifications may be made so long as they do not depart from the spirit of the invention. For instance, the present invention has been described by way of examples in which the above-described embodiments are applied to a sealed scroll compressor having a built-in motor. However, the present may be applied to open scroll compressors without built-in motors, but driven by an external driving source.

The invention claimed is:

1. A scroll compressor comprising shoulder sections at an end surface and a bottom surface of spiral wraps of a paired fixed scroll member and revolving scroll member, which are constructed by vertically mounting the spiral wraps on end plates, and configured to perform three-dimensional compression in a circumferential direction and a height direction of the spiral wraps by setting a spiral wrap height further toward the outside of the spiral wraps than the shoulder sections greater than the spiral wrap height at the inward side, wherein the shoulder sections provided on the end surface and the bottom surface of the spiral wrap are constructed of a plurality of shoulder sections, and heights of the shoulder sections are set to heights such that base stresses at the respective shoulder sections are substantially equal.

2. The scroll compressor according to claim 1, wherein a shoulder-to-shoulder distance H satisfies H≧2L1 when max/min≦1.5, where L1 represents the height of a high shoulder section of the plurality of shoulder sections on the inner side in the spiral direction, H represents the shoulder-to-shoulder distance between the high shoulder section and a low shoulder section on the outer side in the spiral direction, and a represents the stress at the high shoulder section and the low shoulder section.

3. The scroll compressor according to claim 1, wherein a shoulder- to-shoulder distance H satisfies H≧α(L+Lr) when α≧0.5 when the heights of the plurality of shoulder sections are set to be substantially equal, where L represents a wrap height of a spiral wrap on a side further inward than the shoulder section, Lr represents the height of the shoulder constructed of the plurality of shoulder sections, and H represents the shoulder-to-shoulder distance between a high shoulder section on the inner side in the spiral direction of the plurality of shoulder sections and a low shoulder section on the outer side thereof, and $\alpha$ represents the stress at the plurality of shoulder sections.

4. The scroll compressor according to claim 1, wherein ribs are provided at bases of the plurality of shoulder sections, which are provided at the end surfaces of the spiral wraps.

5. The scroll compressor according to claim 4, wherein chamfers or braces for preventing interference with the ribs are provided on the bottom surface side of the counterpart scroll member engaging with the fixed scroll member or the revolving scroll member on which the ribs are provided.

* * * * *